US007772815B2

(12) United States Patent
Okuda et al.

(10) Patent No.: US 7,772,815 B2
(45) Date of Patent: Aug. 10, 2010

(54) CONSTANT VOLTAGE CIRCUIT WITH HIGHER SPEED ERROR AMPLIFIER AND CURRENT LIMITING

(75) Inventors: Tsugunori Okuda, Osaka (JP); Akihito Nagahama, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 534 days.

(21) Appl. No.: 11/652,016

(22) Filed: Jan. 11, 2007

(65) Prior Publication Data

US 2007/0176582 A1 Aug. 2, 2007

(30) Foreign Application Priority Data

Jan. 31, 2006 (JP) ..... 2006-023011

(51) Int. Cl.
*G05F 1/569* (2006.01)

(52) U.S. Cl. ..... 323/280; 323/276; 363/50

(58) Field of Classification Search ..... 323/280, 323/276, 277–279; 361/93.9; 363/50
See application file for complete search history.

(56) References Cited

U.S. PATENT DOCUMENTS 6,922,321 B2 * 7/2005 Katoh et al. ..... 361/93.9
2005/0231180 A1 * 10/2005 Nagata et al. ..... 323/268

FOREIGN PATENT DOCUMENTS

JP 2005-353037 12/2005

* cited by examiner

*Primary Examiner*—Harry Behm
(74) *Attorney, Agent, or Firm*—Dickstein Shapiro LLP

(57) ABSTRACT

A constant voltage circuit is disclosed that includes an output voltage control transistor outputting a current to an output terminal; a first error amplifier circuit part controlling the operation of the output voltage control transistor; a second error amplifier circuit part causing the output voltage control transistor to increase the output current when there is a rapid decrease in an output voltage from the output terminal; and a current limiting circuit part controlling the operation of the output voltage control transistor so as to prevent the output current therefrom from exceeding a first predetermined value by gradually decreasing the output current and the output voltage alternately when the output current is greater than or equal to the first predetermined value. The current limiting circuit part stops the operation of the second error amplifier circuit part when the output voltage is less than or equal to a second predetermined value.

5 Claims, 3 Drawing Sheets

CONSTANT VOLTAGE CIRCUIT WITH HIGHER SPEED ERROR AMPLIFIER AND CURRENT LIMITING

BACKGROUND OF THE INVENTION

1. Field of the Invention

The present invention relates generally to constant voltage circuits, and more particularly to a constant voltage circuit that has a current limiting circuit and can increase the speed of response to a rapid change in input voltage or a sudden change in load current, where the current limiting circuit gradually decreases output current and output voltage alternately so as to perform an overcurrent protection operation having a characteristic close to a foldback characteristic.

2. Description of the Related Art

There has been a conventional constant voltage circuit that can increase the speed of response to a rapid change in input voltage or a sudden change in load current. (See, for example, Japanese Laid-Open Patent Application No. 2005-353037.)

FIG. 1 is a circuit diagram showing such a conventional constant voltage circuit 100.

According to the constant voltage circuit 100 of FIG. 1, in normal times, a first error amplifier circuit AMP1 having an excellent direct-current characteristic controls the operation of an output voltage control transistor M1, thereby converting an output voltage Vo into a constant voltage, and when the output voltage Vo rapidly decreases, a second error amplifier circuit AMP2*a* having excellent high-speed responsiveness controls the operation of the output voltage control transistor M1 for a predetermined period before the first error amplifier circuit AMP1 responds to control the operation of the output voltage control transistor M1, thereby converting the output voltage Vo into a constant voltage.

Further, the constant voltage circuit 100 includes a current limiting circuit 5*a* that limits current output from an output terminal OUT. As shown in FIG. 2, when an output current io reaches a current value ia, the current limiting circuit 5*a* suppresses an increase in the output current of the output voltage control transistor M1, thereby controlling the output voltage control transistor M1 so as to decrease the output voltage Vo. When the output voltage Vo is lowered to a voltage value Vb, an NMOS transistor M22 turns OFF so that the gate voltage of an NMOS transistor M24 increases to decrease the gate voltage of a PMOS transistor M16. As a result, the output current io is limited by a current value ic, so that the output voltage Vo decreases. When the output voltage Vo is lowered to a voltage value Vd, an NMOS transistor M23 further turns OFF so that the gate voltage of the NMOS transistor M 24 further increases to further decrease the gate voltage of the PMOS transistor M16. As a result, the output current io is limited by a current value ie, so that the output voltage Vo further decreases.

However, since the second error amplifier circuit AMP2*a*, which performs feedback control on the output voltage control transistor M1 serving as a driver transistor by extracting a frequency component of the output voltage Vo, is fast in response, the second error amplifier circuit AMP2*a* detects the frequency component of a change in the output voltage Vo so as to try to increase the output voltage Vo to a set voltage when the current limiting circuit 5*a* operates to decrease the output voltage Vo. This causes a problem in that the operation of the constant voltage circuit 100 is unstable. In particular, in a transition from c to d and a transition from e to f in FIG. 2, the second error amplifier circuit AMP2*a* operates so that the current limiting operation of the current limiting circuit 5*a* is destabilized.

SUMMARY OF THE INVENTION

Embodiments of the present invention may solve or reduce the above-described problem.

According to one embodiment of the present invention, there is provided a constant voltage circuit in which the above-described problem is solved or reduced.

According to one embodiment of the present invention, there is provided a constant voltage circuit that can perform a stable overcurrent protection operation when a current limiting circuit, which gradually decreases output current and output voltage alternately so as to perform an overcurrent protection operation having a characteristic close to a foldback characteristic, is put into operation, by stopping the operation of an error amplifier circuit (second error amplifier circuit) when the current limiting circuit operates so that the output voltage becomes lower than or equal to a predetermined value.

According to one embodiment of the present invention, there is provided a constant voltage circuit converting an input voltage input to an input terminal into a predetermined constant voltage and outputting the constant voltage from an output terminal, the constant voltage circuit including an output voltage control transistor configured to output a current according to an input control signal to the output terminal from the input terminal; an output voltage detector circuit part configured to detect an output voltage from the output terminal and to generate and output a voltage proportional to the detected output voltage; a first error amplifier circuit part configured to control an operation of the output voltage control transistor so that the proportional voltage is equal to a predetermined first reference voltage; a second error amplifier circuit part configured to cause the output voltage control transistor to increase the output current for a predetermined time when there is a rapid decrease in the output voltage from the output terminal, the second error amplifier circuit part being higher in a speed of response to a change in the output voltage than the first error amplifier circuit part; and a current limiting circuit part configured to control the operation of the output voltage control transistor so as to prevent the output current from the output voltage control transistor from exceeding a first predetermined value by gradually decreasing the output current and the output voltage from the output terminal alternately when the output current is greater than or equal to the first predetermined value, wherein the current limiting circuit part stops an operation of the second error amplifier circuit part when the output voltage from the output terminal is less than or equal to a second predetermined value.

According to the above-described constant voltage circuit, the current limiting circuit part, which gradually decreases the output current and the output voltage from the output terminal alternately so as to control the operation of the output voltage control transistor so that the output current is prevented from exceeding the first predetermined value when the output current of the output voltage control transistor is greater than or equal to the first predetermined value, stops the operation of the second error amplifier circuit part when the output voltage from the output terminal is less than or equal to the second predetermined value. As a result, it is possible to perform a stable overcurrent protection operation without being affected by the second error amplifier circuit part when the current limiting circuit part, which performs an overcurrent protection operation having a characteristic close to a foldback characteristic by gradually decreasing the output current and the output voltage alternately, is put into operation.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of an embodiment of the present invention.

Figure 3:
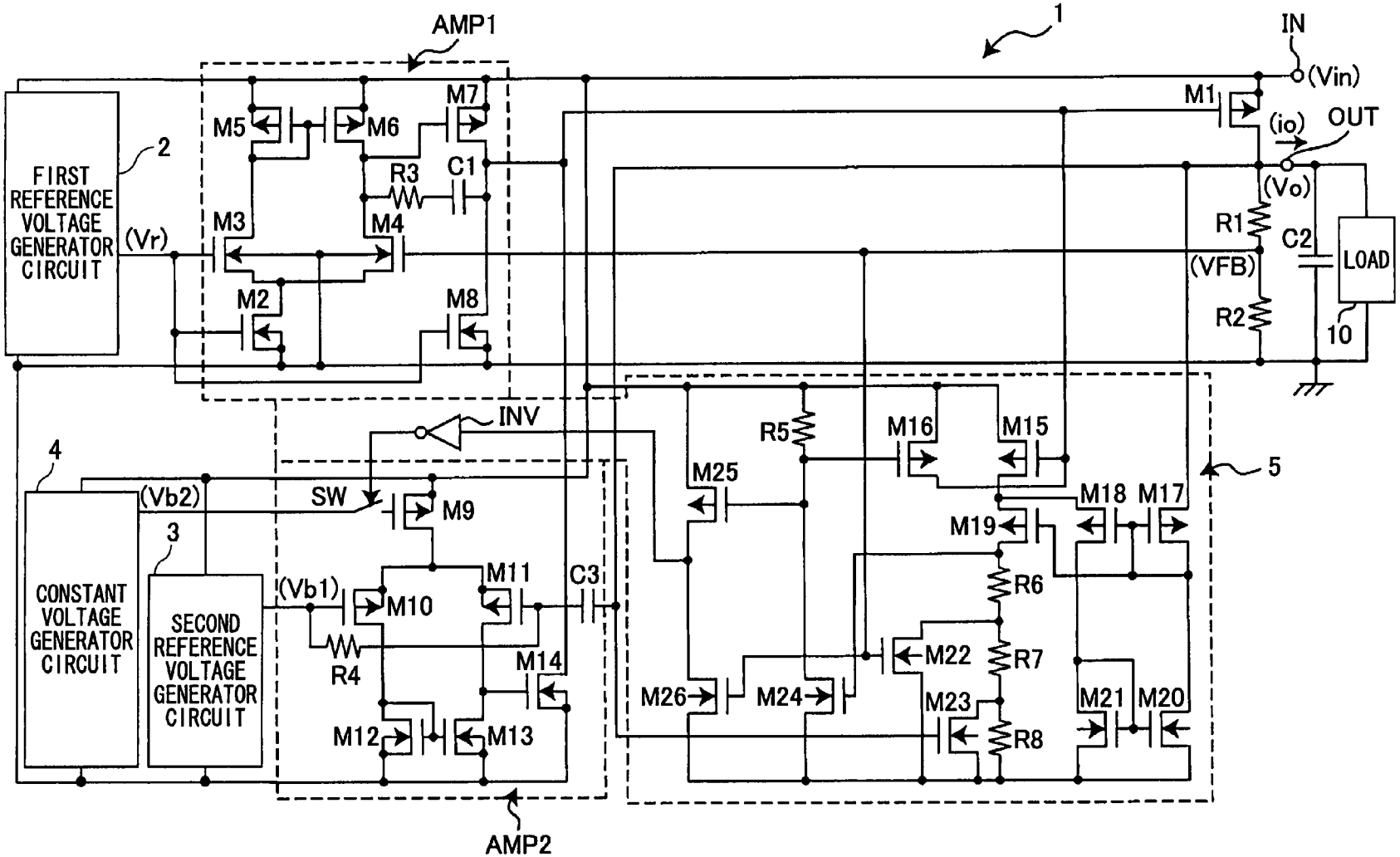
FIG. 3 is a circuit diagram showing a constant voltage circuit according to an embodiment of the present invention.

FIG. 3 is a circuit diagram showing a constant voltage circuit 1 according to the embodiment of the present invention.

Referring to FIG. 3, the constant voltage circuit 1 generates a predetermined constant voltage from an input voltage Vin input to an input terminal IN, and outputs the generated constant voltage from an output terminal OUT as an output voltage Vo. A load 10 and a capacitor C2 are connected in parallel between the output terminal OUT and ground.

The constant voltage circuit 1 includes a first reference voltage generator circuit 2 that generates and outputs a predetermined reference voltage Vr, a second reference voltage generator circuit 3 that generates and outputs a predetermined reference voltage Vb1, and a constant voltage generator circuit 4 that generates and outputs a predetermined bias voltage Vb2.

Further, the constant voltage circuit 1 includes resistors R1 and R2 for voltage detection and an output voltage control transistor M1 formed of a PMOS transistor. The resistors R1 and R2 generate a divided voltage VFB by dividing the output voltage Vo, and output the divided voltage VFB. The output voltage control transistor M1 controls a current io output to the output terminal OUT in accordance with a signal input to the gate of the output voltage control transistor M1. Further, the constant voltage circuit 1 includes a first error amplifier circuit AMP1, a second error amplifier circuit AMP2, and a current limiting circuit 5. The first error amplifier circuit AMP1 controls the operation of the output voltage control transistor M1 so that the divided voltage VFB is equal to the reference voltage Vr. The second error amplifier circuit AMP2 causes the output voltage control transistor M1 to increase the output current for a predetermined time when there is a rapid decrease in the output voltage Vo. The second error amplifier circuit AMP2 is higher in the speed of response to a change in the output voltage Vo than the first error amplifier circuit AMP1. The current limiting circuit 5 gradually decreases the output current io and the output voltage Vo alternately so as to perform an overcurrent protection operation having a characteristic close to a foldback characteristic when the output current io is more than or equal to a predetermined value ia.

The resistors R1 and R2 may form an output voltage detector circuit part; the first error amplifier circuit AMP1 and the first reference voltage generator circuit 2 may form a first error amplifier circuit part; the second error amplifier circuit AMP2, the second reference voltage generator circuit 3, and the constant voltage generator circuit 4 may form a second error amplifier circuit part; and the current limiting circuit 5 may form a current limiting circuit part.

The first error amplifier circuit AMP1 has the reference voltage Vr input to the inverting input thereof and has the divided voltage VFB input to the non-inverting input thereof. The second error amplifier circuit AMP2 has the reference voltage Vb1 input to the non-inverting input thereof and has the output voltage Vo input to the inverting input thereof. The operation of the output voltage control transistor M1 is controlled with the respective output signals of the first and second error amplifier circuits AMP1 and AMP2.

The output voltage control transistor M1 is connected between the input terminal In and the output terminal OUT. The outputs of the first and second error amplifier circuits AMP1 and AMP2 and the current limiting circuit 5 are connected to the gate of the output voltage control transistor M1. Further, a series circuit of the resistors R1 and R2 is connected between the output terminal OUT and ground, and the divided voltage VFB is output from the connection of the resistors R1 and R2.

The first error amplifier circuit AMP1 includes NMOS transistors M2 through M4 and M8, PMOS transistors M5 through M7, a capacitor C1, and a resistor R3. The second error amplifier circuit AMP2 includes PMOS transistors M9 through M11, NMOS transistors M12 through M14, a capacitor C3, a resistor R4, and a switch SW. Further, the current limiting circuit 5 includes PMOS transistors M15 through M19 and M25, NMOS transistors M20 through M24 and M26, resistors R5 through R8, and an inverter INV. The NMOS transistor M14 of the second error amplifier circuit AMP2 may form a control transistor, and the PMOS transistors M9 through M11, the NMOS transistors M12 and M13, and the switch SW of the second error amplifier circuit AMP2 may form a differential amplifier circuit.

In the first error amplifier circuit AMP1, the NMOS transistors M3 and M4 form a differential pair, and the PMOS transistors M5 and M6 form a current mirror circuit and form the load of the differential pair. The source of each of the PMOS transistors M5 and M6 is connected to the input terminal IN. The gates of the PMOS transistors M5 and M6 are connected. The connection of the gates of the PMOS transistors M5 and M6 is connected to the drain of the PMOS transistor M5. The drain of the PMOS transistor M5 is connected to the drain of the NMOS transistor M3, and the drain of the PMOS transistor M6 is connected to the drain of the NMOS transistor M4. The sources of the NMOS transistors M3 and M4 are connected. The NMOS transistor M2 is connected between the connection of the sources of the NMOS transistors M3 and M4 and ground. The first reference voltage generator circuit 2 operates with the input voltage Vin as a power supply. The reference voltage Vr is input to the gate of each of the NMOS transistors M2 and M3. The NMOS transistor M2 forms a constant current source. The divided voltage VFB is input to the gate of the NMOS transistor M4.

Further, the PMOS transistor M7 and the NMOS transistor M8 are connected in series between the input terminal IN and ground. The connection of the PMOS transistor M7 and the NMOS transistor M8 forms the output of the first error amplifier circuit AMP1, and is connected to the gate of the output voltage control transistor M1. The gate of the PMOS transistor M7 is connected to the connection of the PMOS transistor M6 and the NMOS transistor M4. The reference voltage Vr is input to the gate of the NMOS transistor M8. The NMOS transistor M8 forms a constant current source. Further, the capacitor C1 for frequency compensation and the resistor R3 are connected in series between the connection of the PMOS transistor M6 and the NMOS transistor M4 and the connection of the PMOS transistor M7 and the NMOS transistor M8.

Next, in the second error amplifier circuit AMP2, the PMOS transistors M10 and M11 form a differential pair, and the NMOS transistors M12 and M13 form a current mirror circuit and form the load of the differential pair. The source of each of the NMOS transistors M12 and M13 is connected to ground. The gates of the NMOS transistors M12 and M13 are connected. The connection of the gates of the NMOS transistors M12 and M13 is connected to the drain of the NMOS transistor M12. Further, the drain of the NMOS transistor M12 is connected to the drain of the PMOS transistor M10, and the drain of the NMOS transistor M13 is connected to the drain of the PMOS transistor M11. The sources of the PMOS transistors M10 and M11 are connected. The PMOS transistor M9 is connected between the connection of the sources of the PMOS transistors M10 and M11 and the input terminal IN.

Each of the second reference voltage generator circuit 3 and the constant voltage generator circuit 4 operates with the input voltage Vin as a power supply. The bias voltage Vb2 is input to the gate of the PMOS transistor M9 through the switch SW. The reference voltage Vb1 is input to the gate of the PMOS transistor M10. The PMOS transistor M9 forms a constant current source. The capacitor C3 is connected between the gate of the PMOS transistor M11 and the output terminal OUT. Further, the reference voltage Vb1 is input to the connection of the gate of the PMOS transistor M11 and the capacitor C3 through the resistor R4. Further, the NMOS transistor M14 is connected between the gate of the output voltage control transistor M1 and ground. The gate of the NMOS transistor M14 is connected to the connection of the PMOS transistor M11 and the NMOS transistor M13. The drain of the NMOS transistor M14 forms the output of the second error amplifier circuit AMP2.

Next, in the current limiting circuit 5, the source of each of the PMOS transistors M15 and M16 is connected to the input voltage Vin (input terminal IN). The gate of the PMOS transistor M15 and the drain of the PMOS transistor M16 are connected to the gate of the output voltage control transistor M1. The source of each of the PMOS transistors M18 and M19 is connected to the drain of the PMOS transistor M15. The resistors R6 through R8 are connected in series between the drain of the PMOS transistor M19 and ground. The gates of the PMOS transistors M17 through M19 are connected, and the connection of the gates of the PMOS transistors M17 through M19 is connected to the drain of the PMOS transistor M17.

The NMOS transistor M21 is connected between the drain of the PMOS transistor M18 and ground. The gates of the NMOS transistors M20 and M21 are connected. The connection of the gates of the NMOS transistors M20 and M21 is connected to the drain of the NMOS transistor M21. The NMOS transistor M20 is connected between the drain of the PMOS transistor M17 and ground. The NMOS transistors M20 and M21 form a current mirror circuit.

The resistor R5 and the NMOS transistor M24 are connected in series and the PMOS transistor M25 and the NMOS transistor M26 are connected in series between the input voltage Vin (input terminal IN) and ground. The gate of each of the PMOS transistors M16 and M25 is connected to the connection of the resistor R5 and the NMOS transistor M24. The gate of the NMOS transistor M24 is connected to the connection of the PMOS transistor M19 and the resistor R6. The NMOS transistor M22 is connected in parallel with a series circuit of the resistors R7 and R8. The NMOS transistor M23 is connected in parallel with the resistor R8. The divided voltage VFB is input to the gates of the NMOS transistors M22 and M26. The output voltage Vo is input to the gate of the NMOS transistor M23. The connection of the PMOS transistor M25 and the NMOS transistor M26 is connected to the control signal input of the switch SW in the second error amplifier circuit AMP2 through the inverter INV.

A description is given first of the case where the current limiting circuit 5 is not performing an overcurrent protection operation with respect to the output current io in this configuration. In this case, a high-level signal is input to the control signal input of the switch SW of the second error amplifier circuit AMP2, so that the switch SW is ON and closed.

The first error amplifier circuit AMP1 is designed so as to minimize the drain current of the NMOS transistor M2 forming a constant current source so that the first error amplifier circuit AMP1 has an excellent direct-current characteristic with as large a direct-current gain as possible. On the other hand, the second error amplifier circuit AMP2 has the gate of the PMOS transistor M11, serving as an input, connected to the output terminal OUT through the capacitor C3 forming a coupling capacitor. Accordingly, the second error amplifier circuit AMP2 amplifies only the alternating-current component of the output voltage Vo.

Further, the second error amplifier circuit AMP2 is designed so as to maximize the drain current of the PMOS transistor M9 forming a constant current source so that the second error amplifier circuit AMP2 can operate at high speed. Therefore, when there is a steep change in the output voltage Vo, in particular, when the output current io suddenly increases to rapidly decrease the output voltage Vo, the second error amplifier circuit AMP2 controls the operation of the output voltage control transistor M1 for a certain period. At this point, the second error amplifier circuit AMP2 responds to the rapid decrease in the output voltage Vo at high speed, and controls the operation of the output voltage control transistor M1 to increase the output voltage Vo.

Here, a more detailed description is given of the operation in the case where the current io flowing through the load 10 suddenly increases to rapidly decrease the output voltage Vo.

When there is a rapid decrease in the output voltage Vo, it takes time before the first error amplifier circuit AMP1 performs an operation to cause the output voltage control transistor M1 to increase the output current io because the first error amplifier circuit AMP1 is slow in responding to a rapid change in the output voltage Vo. On the other hand, the second error amplifier circuit AMP2 can respond to a rapid change in the output voltage Vo at high speed. Therefore, when there is a rapid decrease in the output voltage Vo, first, only the second error amplifier circuit AMP2 responds to control the operation of the output voltage control transistor M1 so that the output voltage control transistor M1 increases the output current.

In the second error amplifier circuit AMP2, when there is a rapid decrease in the output voltage Vo, the gate voltage of the PMOS transistor M11 decreases through the capacitor C3, and the drain current of the PMOS transistor M11 increases to increase the gate voltage of the NMOS transistor M14. As a result, the drain current of the NMOS transistor M14 increases, so that the gate voltage of the output voltage control transistor M1 decreases to increase the drain current of the output voltage control transistor M1. As a result, the output current io increases to prevent the output voltage Vo from decreasing.

The gate voltage of the PMOS transistor M11 is equalized with the reference voltage Vb1 after a predetermined period since the rapid decrease in the output voltage Vo due to the time constant of the resistor R4 and the capacitor C3. The greater the time constant created by the resistor R4 and the capacitor C3, the better the responsiveness of the second error amplifier circuit AMP2 to a change in the output voltage Vo. On the other hand, the smaller the time constant, the poorer the responsiveness of the second error amplifier circuit AMP2 to a change in the output voltage Vo. Accordingly, for example, the resistance of the resistor R4 may be approximately 2 MΩ and the capacitance of the capacitor C3 may be approximately 5 pF in consideration of other factors such as a layout area.

Here, at least one of the PMOS transistors M10 and M11 is provided with an offset so that when the same voltage is input to the gates of the PMOS transistors M10 and M11, the PMOS transistor M10 outputs a large current while the PMOS transistor M11 outputs an extremely small current. For example, the PMOS transistors M10 and M11 are formed so that the PMOS transistor M10 has a transistor size of W (gate width)/L (gate length)=40 μm/2 μm and the PMOS transistor M11 has a transistor size of W/L=32 μm/2 μm. That is, the PMOS transistors M10 and M11 may be formed so that the transistor size ratio of the PMOS transistors M10 and M11 is approximately 10:8.

Accordingly, when there is no rapid decrease in the output voltage Vo, the NMOS transistor M14 does not control the operation of the output voltage control transistor M1, so that the second error amplifier circuit AMP2 does not affect control of the operation of the output voltage control transistor M1 by the first error amplifier circuit AMP1 in normal times.

Figure 1:
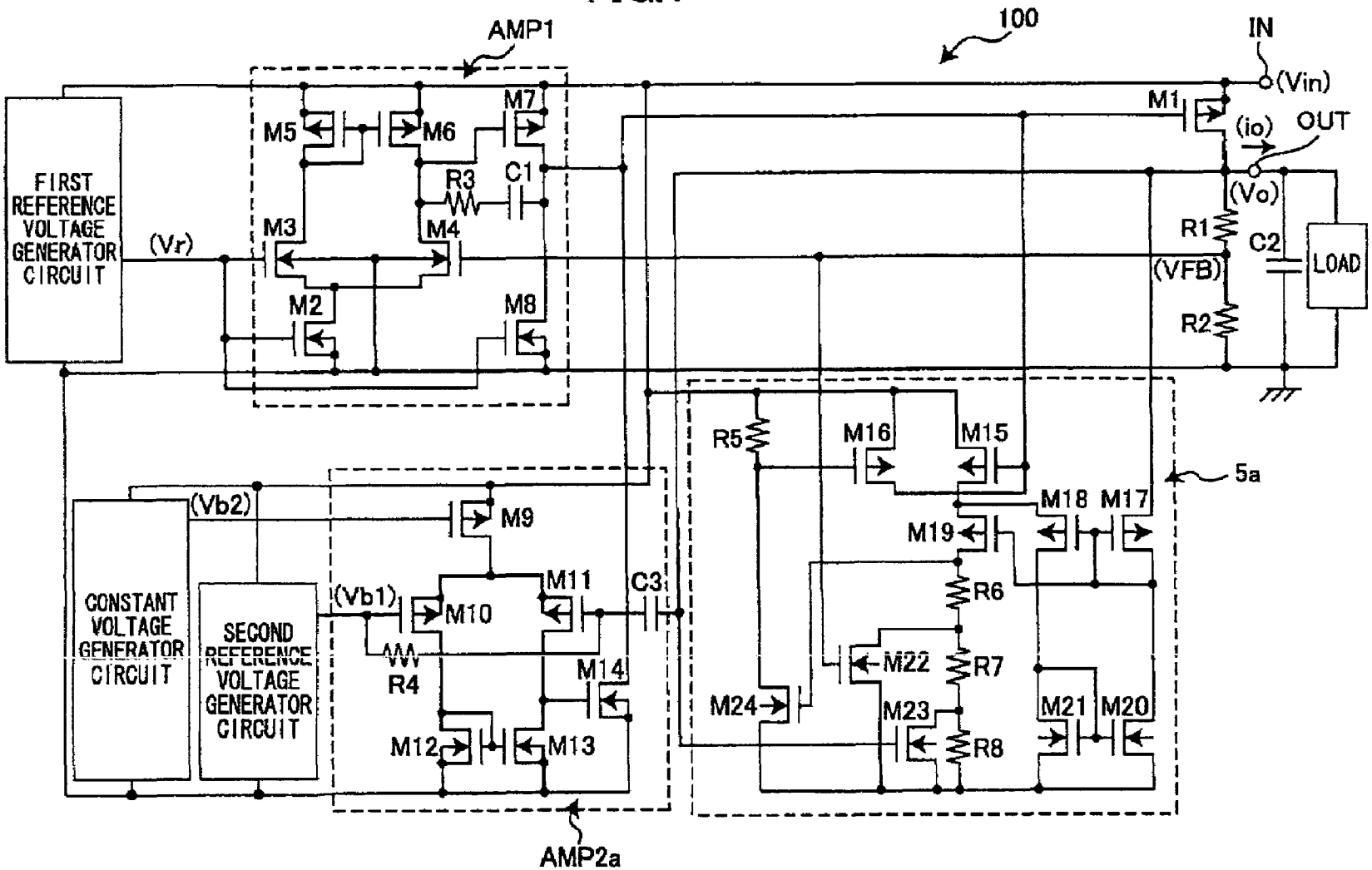
FIG.1 PRIOR ART
FIG. 1 is a circuit diagram showing a conventional constant voltage circuit.
Figure 2:
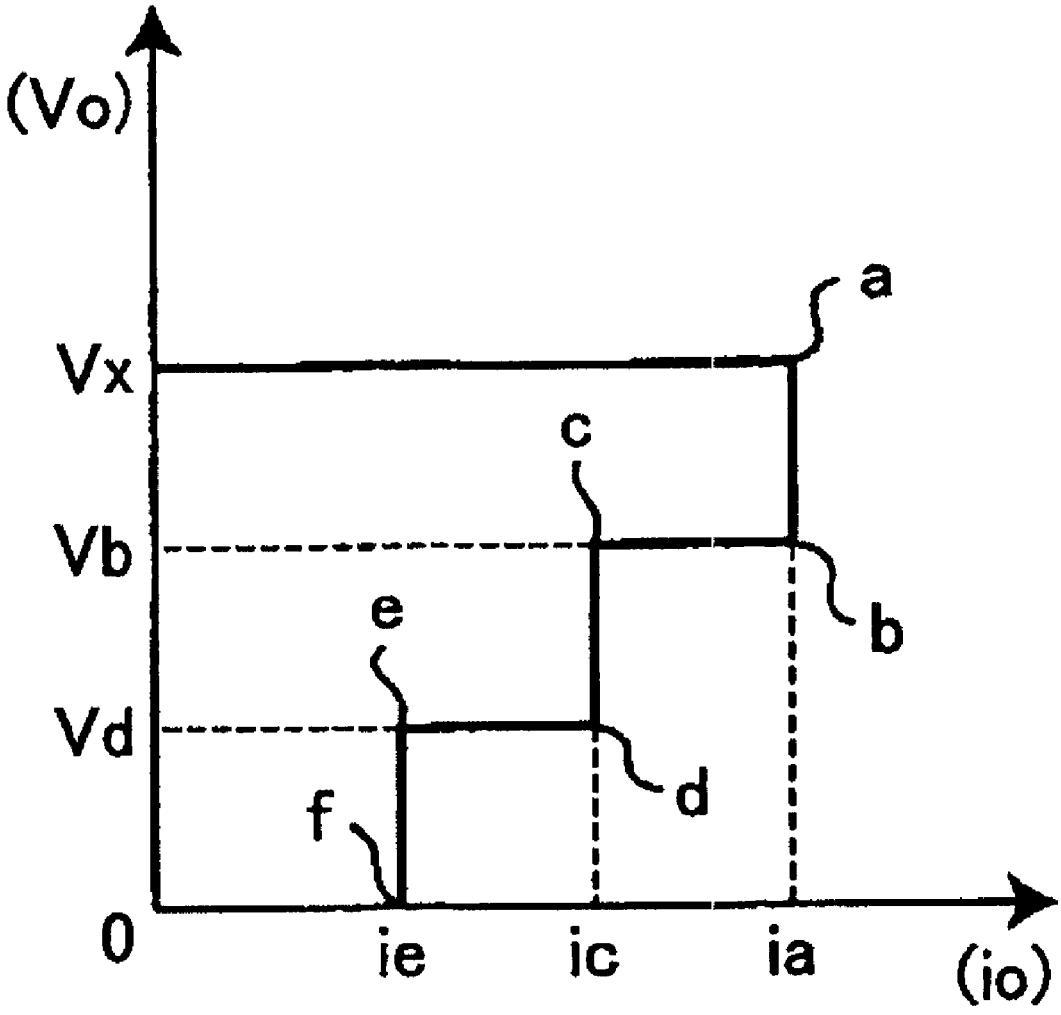
FIG.2 PRIOR ART
FIG. 2 is a graph showing the relationship between the output voltage and output current of a constant voltage circuit at a time when a current limiting circuit is put into operation.

Next, a description is given of an operation of the current limiting circuit 5. The relationship between the output current io and the output voltage Vo at the time when the current limiting circuit 5 is put into operation is the same as shown in FIG. 2, and a description is given, with reference to FIG. 2, of an operation of the current limiting circuit 5.

The current limiting circuit 5 includes the PMOS transistor M15 through which flows a current proportional to a current flowing through the output voltage control transistor M1, which is a driver transistor controlling the output current; a current divider circuit formed of the PMOS transistors M18 and M19; and the resistors R5 through R8, the NMOS transistors M22 through M24, and the PMOS transistor 16 forming a circuit that controls the gate voltage of the output voltage control transistor M1 in accordance with the value of a current flowing through the NMOS transistor M20. Further, the current limiting circuit 5 includes the PMOS transistor M25, the NMOS transistor M26, and the inverter INV, which form a circuit that causes the switch SW of the second error amplifier circuit AMP2 to turn OFF to be closed so as to stop the operation of the second error amplifier circuit AMP2 when the output voltage Vo is less than or equal to a predetermined voltage, that is, the voltage value Vb of FIG. 2.

In the current limiting circuit 5, the drain current of the PMOS transistor M15 is proportional to a current flowing through the output voltage control transistor M1. The drain current is input to the current divider circuit formed of the PMOS transistors M18 and M19 so as to be divided into current values proportional to the size ratio of the PMOS transistors M18 and M19 to be output as the drain currents of the PMOS transistors M18 and M19. The drain current of the PMOS transistor M19 flows into the resistor R6 so as to generate voltage on the drain side of the PMOS transistor M19. The generated voltage is input to the gate of the NMOS transistor M24. When the input voltage reaches the threshold voltage of the NMOS transistor M24, the NMOS transistor M24 turns ON to turn ON the PMOS transistor M16.

The drain of the PMOS transistor M16 is connected to the gate of the output voltage control transistor M1. Therefore, when the PMOS transistor M16 turns ON, the PMOS transistor M16 acts to increase the gate voltage of the output voltage control transistor M1. As a result, the output current of the output voltage control transistor M1 is limited so that the output current io is limited. Thus, the transition from a to b of FIG. 2 occurs, so that the output voltage Vo decreases from a voltage value Vx to the voltage value Vb. The divided voltage VFB is input to the gate of the NMOS transistor M22, and the output voltage Vo is input to the gate of the NMOS transistor M23. The decrease in the output voltage Vo causes the NMOS transistor M22 to turn OFF to be in a non-conducting state, so that the resistor R7 is connected in series to the resistor R6. When the current limiting circuit 5 does not perform a current limiting operation, the NMOS transistor M22 is ON to be in a conducting state, so that the series circuit of the resistors R7 and R8 is short-circuited.

When the resistor R7 is connected in series to the resistor R6, the gate voltage of the NMOS transistor M24 further increases, so that the drain voltage of the PMOS transistor M16 increases to further increase the gate voltage of the output voltage control transistor M1. As a result, the output current io is limited, so that the transition from c to d of FIG. 2 occurs to decrease the output voltage Vo from the voltage value Vb to the voltage value Vd. A further decrease in the output voltage Vo causes the NMOS transistor M23 to turn OFF to be in a non-conducting state, so that the resistor R8 is connected in series to the resistor R7. This further increases the gate voltage of the NMOS transistor M24, so that the gate voltage of the output voltage control transistor M1 further increases. As a result, the output current io is limited, so that the transition from e to f of FIG. 2 occurs to decrease the output voltage Vo from the voltage value Vd to 0.

Here, when the output voltage Vo exceeds the voltage value Vb, the NMOS transistor M26 as well as the NMOS transistor M22 turns ON to be in a conducting state. Therefore, the NMOS transistor M26 causes the output level of the inverter INV to be high, so that the switch SW of the second error amplifier circuit AMP2 turns ON to be closed. As a result, the constant voltage Vb2 is input to the gate of the PMOS transistor M9, so that the PMOS transistor M9 operates as a constant current source so as to put the second error amplifier circuit AMP2 into operation.

When the output voltage Vo is less than or equal to the voltage value Vb, the NMOS transistor M26 as well as the NMOS transistor M22 turns OFF to be in a non-conducting state. Therefore, the PMOS transistor M25 causes the output level of the inverter INV to be low, so that the switch SW of the second error amplifier circuit AMP2 turns OFF to be open. As a result, the PMOS transistor M9 turns OFF so as to stop the operation of the second error amplifier circuit AMP2. That is, the NMOS transistor M14 turns OFF to be in a non-conducting state.

Thus, according to the constant voltage circuit 1 of this embodiment, when the output voltage Vo is less than or equal to the predetermined value Vb, the switch SW turns OFF to be open so that the PMOS transistor M9, forming a constant current source that supplies current to the differential pair of the second error amplifier circuit AMP2, turns OFF to stop supplying current, thereby stopping the operation of the second error amplifier circuit AMP2. As a result, it is possible to perform a stable current limiting operation even when the current limiting circuit 5 having a characteristic close to a foldback characteristic is put into operation.

The above description is given of the case where the current limiting circuit 5 performs a current limiting operation so as to have the characteristic shown in FIG. 2. However, this is one example, and the present invention is applied in the case where a current limiting circuit performs a current limiting operation that gradually decreases the output voltage Vo and the output current io alternately.

According to one embodiment of the present invention, there is provided a constant voltage circuit converting an input voltage input to an input terminal into a predetermined constant voltage and outputting the constant voltage from an output terminal, the constant voltage circuit including an output voltage control transistor configured to output a current according to an input control signal to the output terminal from the input terminal; an output voltage detector circuit part configured to detect an output voltage from the output terminal and to generate and output a voltage proportional to the detected output voltage; a first error amplifier circuit part configured to control the operation of the output voltage control transistor so that the proportional voltage is equal to a predetermined first reference voltage; a second error amplifier circuit part configured to cause the output voltage control transistor to increase the output current for a predetermined time when there is a rapid decrease in the output voltage from the output terminal, the second error amplifier circuit part being higher in the speed of response to a change in the output voltage than the first error amplifier circuit part; and a current limiting circuit part configured to control the operation of the output voltage control transistor so as to prevent the output current from the output voltage control transistor from exceeding a first predetermined value by gradually decreasing the output current and the output voltage from the output terminal alternately when the output current is greater than or equal to the first predetermined value, wherein the current limiting circuit part stops the operation of the second error amplifier circuit part when the output voltage from the output terminal is less than or equal to a second predetermined value.

According to the above-described constant voltage circuit, the current limiting circuit part, which gradually decreases the output current and the output voltage from the output terminal alternately so as to control the operation of the output voltage control transistor so that the output current is prevented from exceeding the first predetermined value when the output current of the output voltage control transistor is greater than or equal to the first predetermined value, stops the operation of the second error amplifier circuit part when the output voltage from the output terminal is less than or equal to the second predetermined value. As a result, it is possible to perform a stable overcurrent protection operation without being affected by the second error amplifier circuit part when the current limiting circuit part, which performs an overcurrent protection operation having a characteristic close to a foldback characteristic by gradually decreasing the output current and the output voltage alternately, is put into operation.

The present invention is not limited to the specifically disclosed embodiment, and variations and modifications may be made without departing from the scope of the present invention.

The present application is based on Japanese Priority Patent Application No. 2006-023011, filed on Jan. 31, 2006, the entire contents of which are hereby incorporated by reference.

What is claimed is:

1. A constant voltage circuit converting an input voltage input to an input terminal into a predetermined constant voltage and outputting the constant voltage from an output terminal, the constant voltage circuit comprising:

an output voltage control transistor configured to output a current according to an input control signal to the output terminal from the input terminal;

an output voltage detector circuit part configured to detect an output voltage from the output terminal and to generate and output a voltage proportional to the detected output voltage;

a first error amplifier circuit part configured to control an operation of the output voltage control transistor so that the proportional voltage is equal to a predetermined first reference voltage;

a second error amplifier circuit part configured to cause the output voltage control transistor to increase the output current for a predetermined time when there is a rapid decrease in the output voltage from the output terminal, the second error amplifier circuit part being higher in a speed of response to a change in the output voltage than the first error amplifier circuit part, wherein the second error amplifier circuit part comprises:

a control transistor configured to control the operation of the output voltage control transistor in accordance with an input control signal;

a differential amplifier circuit having a predetermined second reference voltage input to a first input thereof, the differential amplifier circuit being configured to control an operation of the control transistor so that a voltage at a second input of the differential amplifier circuit is equal to the second reference voltage, wherein the differential amplifier circuit comprises:

a differential pair formed of a pair of transistors;

a load circuit forming a load of the differential pair; and a constant current circuit configured to supply a predetermined constant current to the differential pair; and the current limiting circuit part stops the supply of the constant current by stopping an operation of the constant current circuit when the output voltage from the output terminal is less than or equal to the second predetermined value;

a capacitor connected between the second input of the differential amplifier circuit and the output voltage from the output terminal; and a fixed resistor connected between the first input and the second input of the differential amplifier circuit; and a current limiting circuit part configured to control the operation of the output voltage control transistor so as to prevent the output current from the output voltage control transistor from exceeding a first predetermined value by gradually decreasing the output current and the output voltage from the output terminal alternately when the output current is greater than or equal to the first predetermined value, wherein the current limiting circuit part stops an operation of the second error amplifier circuit part when the output voltage from the output terminal is less than or equal to a second predetermined value.

2. The constant voltage circuit as claimed in claim 1, wherein the first error amplifier circuit part has a greater direct-current gain than the second error amplifier circuit part.

3. The constant voltage circuit as claimed in claim 1, wherein the second error amplifier circuit part amplifies only an alternating-current component of the output voltage from the output terminal.

4. The constant voltage circuit as claimed in claim 1, wherein:

the constant current circuit comprises a transistor configured to form a constant current source, the transistor having a predetermined constant voltage input to a control electrode thereof; and a switch configured to control an output of the constant voltage to the control electrode of the transistor in accordance with an input control signal; and the current limiting circuit part causes the switch to interrupt the supply of the constant voltage to the control electrode of the transistor when the output voltage from the output terminal is less than or equal to the second predetermined value.

5. The constant voltage circuit as claimed in claim 1, wherein at least one of the transistors forming the differential pair of the differential amplifier circuit is provided with an offset, and a first current flowing through one of the transistors forming the differential pair is smaller than a second current flowing through another one of the transistors forming the differential pair when the change in the output voltage is less than or equal to a predetermined value.

* * * * *